US007047653B2

(12) United States Patent
Fitzgerald

(10) Patent No.: US 7,047,653 B2
(45) Date of Patent: May 23, 2006

(54) DEPTH CORRECTION

(75) Inventor: Peter Fitzgerald, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/504,794

(22) PCT Filed: Jan. 27, 2003

(86) PCT No.: PCT/EP03/50000

§ 371 (c)(1),
(2), (4) Date: Aug. 13, 2004

(87) PCT Pub. No.: WO03/069119

PCT Pub. Date: Aug. 21, 2003

(65) Prior Publication Data

US 2005/0138830 A1 Jun. 30, 2005

(30) Foreign Application Priority Data

Feb. 18, 2002 (GB) ..... 0203731.5

(51) Int. Cl.
*E21B 47/04* (2006.01)

(52) U.S. Cl. ..... 33/304; 175/40; 73/152.54

(58) Field of Classification Search ..... 33/301–304, 33/312, 542, 544, 713, 716, 719; 73/152.46, 73/152.54; 166/66; 175/40, 57
See application file for complete search history.

(56) References Cited

U.S. PATENT DOCUMENTS 2,250,462 A 7/1941 Boynton
3,497,958 A 3/1970 Gollwitzer
4,117,600 A 10/1978 Guignard et al.
4,545,242 A 10/1985 Chan (Continued)

FOREIGN PATENT DOCUMENTS

GB 1277297 6/1972

(Continued)

OTHER PUBLICATIONS

Chan D S K "Accurate Depth Determination in Well Logging" IEEE Transactions on Acoustics, Speech and Signal Processing, NY, US vol. 32, No. 1 p. 42-48 (Feb. 1, 1984).

*Primary Examiner*—G. Bradley Bennett
(74) *Attorney, Agent, or Firm*—Victor H. Segura; Brigitte L. Echols

(57) ABSTRACT

A method of determining the depth of equipment in an underground borehole, the equipment being suspended in the borehole by means of a cable extending from the surface into the well, comprises: (i) determining the amount of cable introduced into the well at the surface; (ii) dividing the cable in the borehole into a series of elements; (iii) determining the tension in each element of the cable in the borehole; (iv) determining the stretch of the cable in the borehole for the determined tension in all elements; and (v) determining the depth of the equipment from the determined amount of cable introduced into the well from the surface and from the determined stretch of the cable in the borehole. The method can be used for correcting a depth measurement or determining an error in a depth measurement made on the cable at the surface by determining a correction factor using the methodology described above. The correction or error determination can be applied directly to log data as well as to the depth measurement.

9 Claims, 2 Drawing Sheets

U.S. PATENT DOCUMENTS

| | | | | |
|---|---|---|---|---|
| 4,718,168 | A | 1/1988 | Kerr | |
| 4,852,263 | A | 8/1989 | Kerr | |
| 5,019,978 | A | 5/1991 | Howard, Jr. et al. | |
| 5,062,048 | A | 10/1991 | Coulter et al. | |
| 5,351,531 | A * | 10/1994 | Kerr | 73/152.54 |
| 5,469,916 | A * | 11/1995 | Sas-Jaworsky et al. | 166/66 |
| 6,450,259 | B1 * | 9/2002 | Song et al. | 166/255.1 |
| 6,704,655 | B1 * | 3/2004 | Kelly | 33/735 |
| 2002/0195276 | A1 * | 12/2002 | Dubinsky et al. | 175/40 |
| 2005/0087368 | A1 * | 4/2005 | Boyle et al. | 175/57 |

FOREIGN PATENT DOCUMENTS

| | | | |
|---|---|---|---|
| WO | WO 02066921 | A | 8/2002 |

* cited by examiner

DEPTH CORRECTION

The present invention relates to a method for the determination of the depth of equipment lowered into a borehole by means of a cable. In particular, the invention provides a method for the determination of the depth of a tool in a borehole for making measurements or performing operations, or for correcting such depth determinations made at the surface.

In a well logging operation (see FIG. 1), a toolstring including one or more tools is lowered into a borehole on the end of a cable (wireline) which connects the tool to an acquisition system at the surface and provides power and/or data from the surface. Once the tool reaches the bottom of the borehole, it is then raised to the surface while measurements are made on the formation or in the borehole. The cable is provided on a winch drum (not shown) in the surface unit and the depth of the tool in the borehole is determined by measuring the amount of cable entering or leaving the borehole by means of a measurement wheel that is displaced somewhat from the cable drum.

In wireline logging, measured depth (that is, the position of the logging tool measured along the borehole) is often considered to be the most important measurement that is made. For example, logs from different wells in the same field are often depth-matched in order to determine the extent, and varying thicknesses, of the hydrocarbon-bearing zones. Any errors in the depth measurements made during data acquisition may thus affect significantly the subsequent interpretation of the data.

Wireline logging cables are somewhat elastic (that is, their length changes with tension) and are also subject to temperature dilation (that is, their length changes with temperature). At present the only robust depth measurement made during wireline data acquisition is made by measuring the movement of the logging cable at surface conditions, typically by measuring the rotation of a calibrated wheel pressed against the cable. Perhaps surprisingly, this measurement automatically takes into account much of the effect of cable stretch due to varying tensions.

Consider a short section of cable leaving the winch drum as the tool is lowered down the wellbore. As soon as the frictional forces restraining this element are relieved as it leaves the drum, the element will be subject to the tension required to support the weight of the toolstring and the cable already in the borehole. This tension will, in general, cause the length of the element of cable to change, but as this change takes place before the cable element passes in front of the measuring device, it follows that the measuring device correctly measures the length of the stretched cable. As the tool continues down the borehole, each cable element moves down the borehole also. In a vertical well, the tension in the cable element will not change, as it is still supporting the weight of the toolstring and cable below. Thus, apart from dilation with changing temperature, its length will not change and the measurement wheel thus measures correctly the true depth of the toolstring. The same reasoning may be used to show that the depth measurement of the measurement wheel is accurate as the toolstring is subsequently removed from the well.

In a deviated well, however, the problem is more complex. As the toolstring is lowered, the wellbore deviation from the vertical changes, and so the tension distribution in the cable changes. Thus the measurement already made by the measurement wheel will be in error as each element of the cable already in the wellbore changes its length. The same reasoning shows that while removing the tool from the wellbore the measurement wheel will again be inaccurate.

The problem of predicting, or more correctly modeling, the cable tensions that are observed during wireline data acquisition is rather well understood, and some existing software packages attempt to do this. One such package is "Cerberus", produced by Coiled Tubing Engineering Services (CTES, LC of Conroe, Tex.). Given that the cable tension profile can be modeled for all depths of the logging tool, a rather simple software addition allows the computation of the "stretch" of the cable as a function of tool depth. The "Cerberus" package does this.

What is of primary interest, however, is to estimate the error in tool measured depth: this is not equal to the "stretch" computed as indicated above, as some of this stretch is already accounted for by the depth measurement process. The previous methods of depth measurement can be shown to lead to significant errors, potentially in the order of 5 m for a well of 3000 m.

Various techniques have been proposed to provide corrected depth measurements using a measurement wheel of the type described above. Examples of these techniques can be found in U.S. Pat. No. 4,117,600 U.S. Pat. No. 4,545,242 and U.S. Pat. No. 5,019,978 and in Chan, David, S. K., "Accurate Depth Determination in Well Logging", IEEE Transactions on Acoustics, Speech, and Signal Processing, vol. ASSP-32, No.1, February 1984, pp. 42–48. However, none of these methods address the problem identified above.

It is an object of the present invention to provide a correction to be applied to the wireline depth measured at surface in order to recover the true tool depth.

In one aspect the present invention provides a method of determining the depth of equipment in an underground borehole, the equipment being suspended in the borehole by means of a cable extending from the surface into the well, comprising:

(i) determining the amount of cable introduced into the well at the surface;

(ii) dividing the cable in the borehole into a series of elements;

(iii) determining the tension in each element of the cable in the borehole;

(iv) determining the stretch of the cable in the borehole for the determined tension in all elements; and (v) determining the depth of the equipment from the determined amount of cable introduced into the well from the surface and from the determined stretch of the cable in the borehole.

Another aspect of the invention provides a method of correcting a depth measurement or determining an error in a depth measurement made on the cable at the surface by determining a correction factor using the methodology described above.

The correction or error determination can be applied directly to log data as well as to the depth measurement.

The methods according to the invention can be applied to measurements or data either after acquisition or in real time during acquisition.

The present invention will now be described by way of example, with reference to the accompanying drawings, in which.

Figure 1:
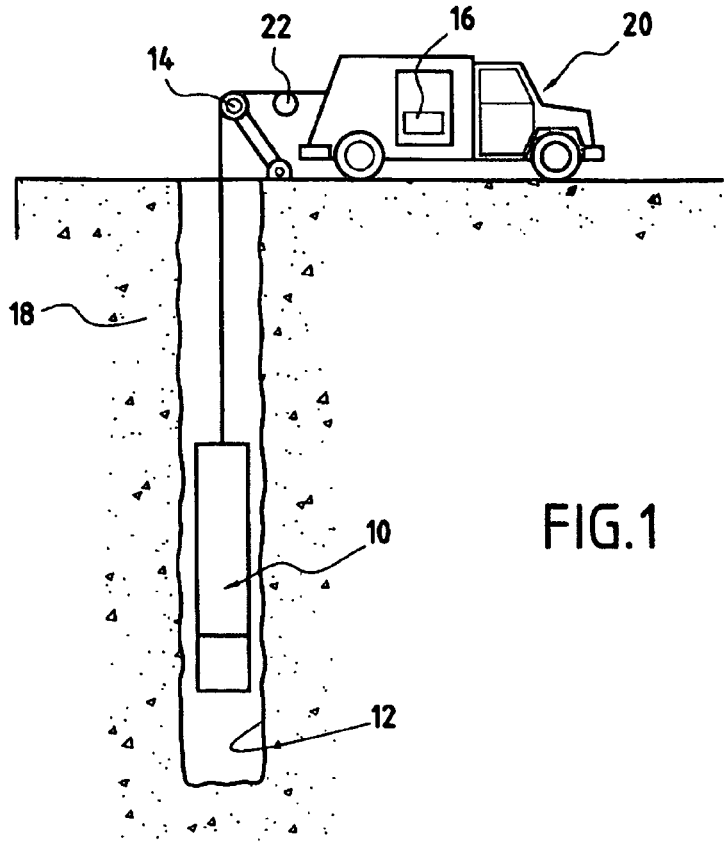
FIG. 1 shows a wireline logging operation.

The invention is implemented as a software program that can be run on a computer in the surface unit or later in a computer at a different location.

The user enters a description of the wellbore environment and the toolstring and cable being used to log the well. The software discretises the wellbore into short sections, and then, for each possible tool depth, it computes the tension profile along the cable from the tool to surface.

The parameters required as input to the computation as a description of the wellbore environment and the toolstring and cable being used to log the well may be divided into groups:

- Wellbore Definition
- The inclination and azimuth of the borehole at various depths
- The diameter of the borehole as a function of depth
  - This information is available from data obtained during the drilling of the well.
- Wellbore temperature as a function of depth, and surface temperature
  - This information is available from measurements made during drilling, logging or at the surface.
- The density and other properties of the wellbore fluid
  - This information is available from data obtained during the drilling phase of the well, or analysis of the well fluids when the well is producing.
  - Full fluid properties and volumetric flow rates (together with more information about the configuration of the tool) if it is required to consider the effects of flowing fluid on the tool ("lift forces"). For example, if the tool is logging in a producing well, such as production logging, the flow of the fluid up the well will have an effect on the tension that depends upon the flow rate and density which may vary along the well.
  - Wellbore fluid viscosity as a function of depth and toolstring velocity up and down (if it is desired to consider the effect of wellbore fluid viscosity on a moving toolstring)
- Downhole Equipment Definition
- The weight of the toolstring in air and the wellbore fluid
- The dimensions of the toolstring
- The properties of the cable (diameter, weight per unit length in air and water, temperature and tension dilation coefficients, roughness)
  - All of these are available from information obtained at the surface.
- Modelling Parameters
- Friction coefficients between the cable and open/cased hole sections, and between the toolstring and open/cased hole sections.
  - These can be determined from offset data from wells in the same region, or estimated from a collection of such data from wells of similar geometry and properties for which accurate data is available.
- Additional forces due to centralisers, calipers, and so on, which may vary depending upon whether the tool is being moved up or down
  - These can be calculated from theory or based on empirical data obtained elsewhere.
- Wellhead pressure
  - Measured at the surface.
- Additional friction due to pressure control equipment at surface
  - Estimated from surface measurements.

The software works by computing the tension at the head (that is, the connection between the cable and tool) of the toolstring, when the tool is in a defined position downhole. This is computed as the sum of a number of force terms:

- The weight of the toolstring, resolved along the borehole
- The friction due to lateral forces (tool weight and additional force due to centralisers), which must be added (if the tool is moving up) or subtracted (if the tool is moving down)
- Any additional force due to fluid motion ("lift forces") or tool motion in the wellbore fluid.

Given this as a boundary condition, a computation may be performed on a small element of cable just above the tool head: as the local wellbore deviation and curvature is known, together with the local friction coefficient and fluid properties, the change in tension along this element of cable may be estimated as a sum of forces, as for the tool itself. It may be seen that, by repeating this process for all cable elements up to surface, a complete profile of cable tension may be computed. Then, with the toolstring assumed to be at a different position in the borehole, the process may be repeated.

The manner in which the elements making up the whole cable are defined can be varied according to requirements. Typically, an element of the cable is defined as a portion of the cable for which the tension may be considered as effectively constant for that measurement. For example, an element of cable may be defined as that part of the cable in a section of borehole for which the deviation in either inclination or azimuth is less that 1 degree. Other indicators for defining elements might be the change from cased hole to open hole, known changes in hole diameter or conditions, etc.

Once this has been accomplished, the software can estimate, for each 'true' tool depth, the length of cable (in its stretched state) that has passed in front of the depth-measuring device.

With the tool at surface (which may be considered to be in the borehole but at zero depth) the tension in the first element of cable, when it passes in front of the measurement wheel, may be estimated as described above. The "stretch" of the cable, compared to its length at zero tension, may thus be estimated. As the tool moves downhole, the tension in this element, and its temperature, will change. As the stretch of the cable is known to be a function of tension and temperature, the difference in length of the element from when it was measured at surface may be computed by simply considering its tension and temperature when the tool is downhole at a given depth, and its tension and temperature when it was passing in front of the measurement wheel at surface. Summing these differences in depth over the whole length of the cable, with the tool at all possible depths in the borehole, allows us to estimate the difference between the "measurement wheel indicated depth" and the "true tool depth" (or "depth error") as a function of tool depth.

As the tension in each element of cable varies depending upon whether the tool is moving up or down (as the sign of the friction terms changes), it follows that the "depth error" also changes. Applying the technique described above allows computation of the depth error when the tool is moving up, also.

The continuous estimate of depth correction required versus true (or, by calculation, measured) depth may be applied to the log data either by playing back data that has been acquired previously, or during data acquisition, to produce a log of wellbore data versus corrected depth.

Figure 2:
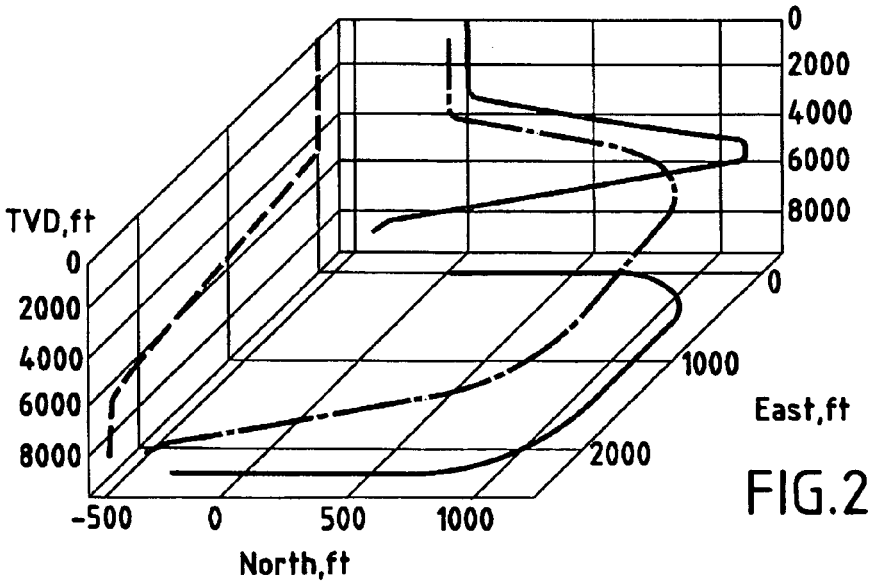
FIG. 2 shows a plot of a three dimensional well plan and the trajectories in each dimension.
Figure 3:
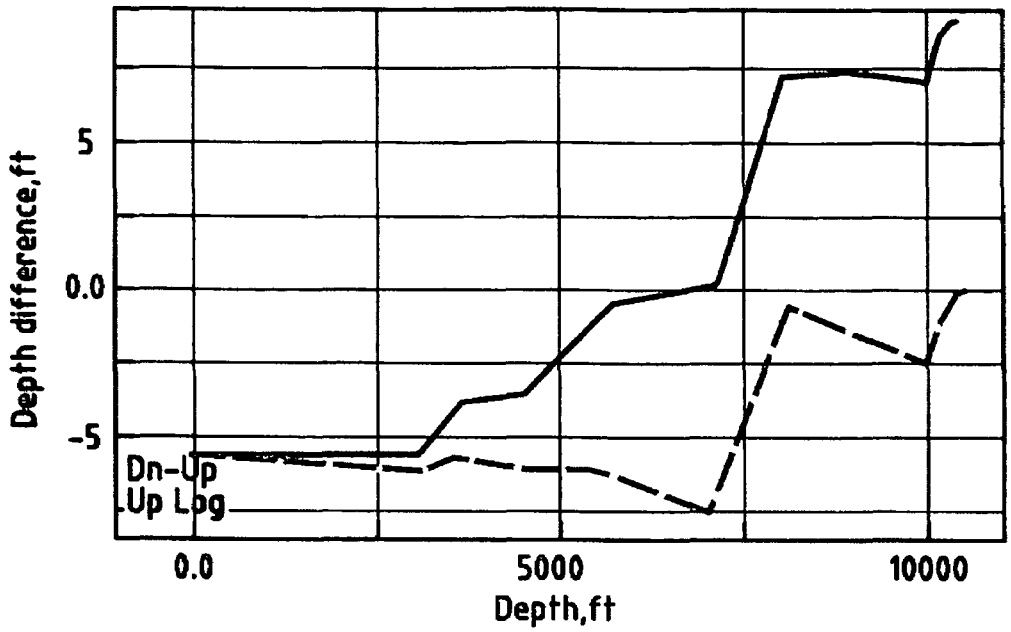
FIG. 3 shows a plot of determined depth differences and cumulative depth error in a logging operation.
Figure 4:
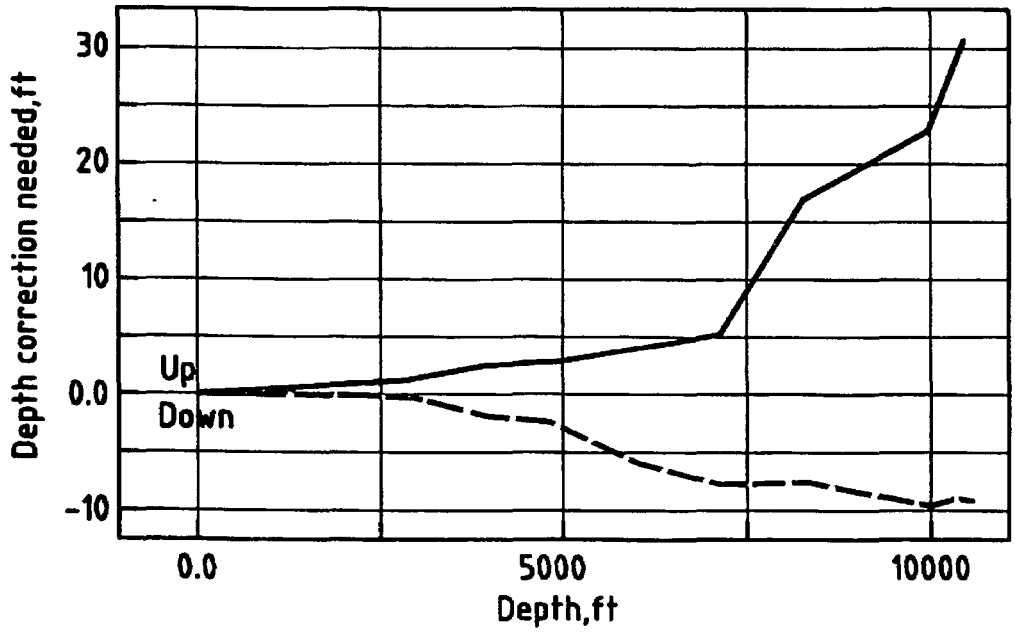
FIG. 4 shows a plot of depth correction to be applied to logging measurements.

An example of the estimated tensions expected to be observed at surface when logging up and when logging down, in a typical deviated well, is provided in FIG. 2. FIG. 3 shows an estimate of the expected "depth error" when the tool is lowered down the borehole, and the expected initial depth error if the winch is stopped and the toolstring raised in the wellbore. FIG. 4 shows an estimate of how the "depth error" evolves during a logging session, when the tool is removed from the wellbore, assuming that an offset is applied to the depth at the maximum depth so that the error there is reset to zero. It also shows the expected depth difference between well logs recorded with the tool going down and the tool coming up as a function of depth. This last quantity is a useful check on the suitability of both the algorithms used and the parameters selected, as a simple correlation procedure between the "down log" and "up log", both recorded during typical well-logging operations, permits a direct comparison between the predicted and observed values. Note that there is no direct way to validate the absolute value of the "depth error", but validation of this difference should give confidence in the predictions of the absolute quantity. An additional, but less complete, validation may be performed by comparing the modelled and measured tensions at different tool depths.

The software for implementing a method according to the invention can take a two-stage approach. In the first stage, the tension in the cable is determined for each position of the tool in the well. In the second stage, the stretch of the cable is computed according to the determined tensions. In both stages, the parameters discussed above are used to allow the software to perform the calculations.

Computation of Tension

The tension in each element of cable in the well is computed for each position of the tool in the well and stored in an array. Since the tension will be different when the tool is moving up or down in the well, the computation is performed for each direction:

1. Determine array position of tool to be used for first tension computation.
2. Set weight of tool (this may be the weight in air, well fluid or a combination of the two depending on the position of the tool in the well and the fluid level in the well).
3. Determine direction of movement (is tool moving up or down in the well?).
4. Determine which parameters dependent on direction are to be applied to the calculation and in what manner.
4. Determine bending effects, if any. Since for long tool strings or high deviations in well trajectory, it is possible that the tool string may have to bend to pass through a portion of the well, the drag arising from the bending can be calculated. In order to do this, the difference in azimuth and deviation between the top and bottom of the portion of the well is determined (data available from input parameters).
5. Include other imposed tensions (e.g. tractor force if tractor present and running into well).
6. Compute tension at head of tool from tool weight, the friction effects, lift forces, deviation of borehole, etc.
7. Work up the cable, one element at a time, computing the tension in each element. This will depend on the tool weight and other factors (as determined above), the cable weight in the element(s) below, and the other factors affecting the contribution of the cable below the element in question to the computed tension (friction, deviation, etc.).

The result of this computation is an array of cable tension "maps" for each position of the tool in the well.

Computation of Stretch

The second stage of the computation determines the stretch of the cable for each position of the tool in the well, using the tension array previously computed. There are three stretch computations that can be made: the stretch "seen" by the measuring wheel at the surface, the stretch of the cable in the hole with the tool moving down, and the stretch of the cable in the hole with the tool moving up. Note that the stretch seen at the surface and the stretch with the tool moving down should be the same if the well is vertical and friction is constant, i.e. the measuring wheel will measure the "true" tool depth.

1. Compute dilation/contraction of cable due to temperature for each element in the well (temperature and temperature coefficients being input parameters).
2. Compute "surface measurement system" stretch. As each element of cable is spooled into the well, it has a known tension (computed in the previous stage as the tension in the cable at the surface with the tool at the respective depth). This tension results in a stretch of that element of cable as it is spooled into the well. Since the (stretched) length of cable entering the well is known, the surface measured stretch of the cable for the tool at that depth can be determined. The previous stage provides the computed tension for each element as it enters the well so from the surface measurement, the total surface measured stretch for the tool at a given depth can be computed. It is assumed for this computation that the length of cable moving past the surface measuring system is equal to the change in depth of the tool. While this is not absolutely true, there being some stretch, the error is relatively small.
3. Compute the stretch of the cable in the well from surface to tool depth. Since the tension in each cable element at the surface for each position of the tool in the well between the surface and the current depth is computed (from the first stage), and the tension in each element of the cable in the well with the tool at the current depth in the well is computed (again, from the first stage), the difference between the two can be computed and so the difference in stretch determined and hence the measured depth corrected.
4. For the tool at a given depth, the difference between the up- and down-log computed stretches, and between the surface measured and up-log computed stretches are determined to generate depth corrections or depth measurement error estimates.

The exact manner in which the physical behaviour of the cable and tool in the well is parameterised and modelled is not essential to the invention but can be varied according to particular requirements of the system used to measure depth, for example.

An example of the present invention can be considered in relation to the well trajectory shown in FIG. 2 which shows the well path and also the deviations in each of the three dimensions. The parameters of the well, tool string, cable, etc. are shown in Table 1 below:

TABLE 1

| Borehole-Related Parameters | |
|---|---|
| Open or Cased hole | Cased |
| Fluid Depth in Wellbore | 0 ft |

TABLE 1-continued

| | |
|---|---|
| Measured Depth | 12,000 ft |
| Wellhead Gauge Pressure | 0 psi |
| Surface Temperature | 75° F. |
| Bottom-Hole Temperature | 200° F. |
| Tool and Cable Definition Parameters | |
| Toolstring Weight in Air | 1,200 lb |
| Toolstring Diameter | 3.375 in |
| Toolstring Length | 70 ft |
| Toolstring Weight in Fluid | 900 lb |
| Flow-tube Drag at Surface | 0 lb |
| Centraliser Drag Moving Up | 200 lb |
| Centraliser Drag Moving Down | 200 lb |
| Tractor Present | No |
| Cable Friction Coeff (cased hole) | 0.35 |
| Tool Friction Coeff (cased hole) | 0.35 |
| Cable Outer Diameter | 0.464 in |
| Cable Weight in Air | 332 lb/ft |
| Cable Weight in Water | 265 lb/ft |
| Stretch Coeff | $9.63 \times 10^{-7}$ ft/ftlb |
| Temperature Coeff | −8.36 10−6 ft/ft ° F. |

Applying these parameters in the method of the invention gives the following information:

| | |
|---|---|
| Normal Surface Tension with Tool at TD | 7965.6 lb |
| Depth Correction to add to Total Depth | 28.2 ft |
| Up/Down Log Depth Difference at Total Depth | 37.2 ft |

| Measured Depth ft | Tension UP lb | Tension DOWN lb |
|---|---|---|
| 0 | 1100.0 | 700.0 |
| 500 | 1225.9 | 825.9 |
| 1000 | 1351.7 | 951.7 |
| 1500 | 1477.6 | 1077.6 |
| 2000 | 1603.4 | 1203.4 |
| 2500 | 1729.3 | 1329.3 |
| 3000 | 1855.1 | 1455.1 |
| 3500 | 2212.4 | 1291.4 |
| 4000 | 2386.7 | 1308.8 |
| 4500 | 2543.9 | 1381.1 |
| 5000 | 2793.6 | 1303.1 |
| 5500 | 3034.2 | 1210.0 |
| 6000 | 3235.3 | 1146.1 |
| 6500 | 3420.0 | 1167.9 |
| 7000 | 3604.7 | 1188.5 |
| 7500 | 4374.1 | 1325.1 |
| 8000 | 5223.5 | 1418.4 |
| 8500 | 5872.3 | 1475.0 |
| 9000 | 6238.8 | 1507.2 |
| 9500 | 6605.4 | 1539.0 |
| 10000 | 6972.2 | 1570.7 |
| 10500 | 7848.9 | 1661.0 |

FIG. 3 shows a plot of the difference between the down log and up log depths determined from this data, and the accumulated error in the up log. FIG. 4 shows the stretch correction that must be applied to determine the tool depth from the measured depth.

The invention claimed is:

1. A method of determining the depth of equipment in an underground borehole, the equipment being suspended in the borehole by means of a cable extending from the surface into the well, comprising:

(i) determining the amount of cable introduced into the well at the surface;

(ii) dividing the cable in the borehole into a series of elements;

(iii) defining each element in the series as a portion of the cable for which the tension can be considered as effectively constant;

(iii) determining the tension in each element of the cable in the borehole;

(iv) determining the stretch of the cable in the borehole for the determined tension in all elements; and (v) determining the depth of the equipment from the determined amount of cable introduced into the well from the surface and from the determined stretch of the cable in the borehole.

2. The method as claimed in claim 1, comprising:

(i) determining a series of parameters relating to the borehole;

(ii) determining a series of parameters relating to the equipment;

(iii) using the borehole and equipment parameters to determine a series of parameters related to the interaction of the equipment with the borehole;

(iv) determining the tension in the in each element of the cable using the determined parameters.

3. The method as claimed in claim 1, comprising determining the tension at the surface for the tool at each depth in the well, and using this determined tension to compute stretch in the cable measured at the surface.

4. The method as claimed in claim 3, further comprising determining the stretch in the cable in the borehole and using the difference between the stretch determined in the borehole and the computed stretch at surface to correct the determined depth of the tool in the borehole.

5. The method as claimed in claim 2, wherein the parameters include one or more of inclination and azimuth of the borehole, diameter of the borehole, temperature, density and other properties of the borehole fluid, weight of the tool, dimensions of the tool, properties of the cable, friction coefficients between cable or tool and the borehole, additional frictional forces, and wellhead pressure.

6. The method as claimed in claim 5, further including dynamic parameters due to flowing wellbore fluids or due to the movement of the tool in the wellbore fluids.

7. The method as claimed in claim 1, further comprising determining an error in a tool depth measurement made from the surface.

8. The method as claimed in claim 7, wherein the error is used to correct the depth measurement.

9. The method as claimed in claim 1, further comprising determining corrections to be applied to log data acquired by the equipment in the well.

* * * * *